United States Patent [19]

Haley

[11] Patent Number: 4,523,706

[45] Date of Patent: Jun. 18, 1985

[54] AUTOMATIC BATTEN SETTER

[76] Inventor: Norman S. Haley, P.O. Box 32, Chantilly, Va. 22021

[21] Appl. No.: 482,719

[22] Filed: Apr. 7, 1983

[51] Int. Cl.[3] ..... B25C 5/13; B25C 7/00; B27F 7/09

[52] U.S. Cl. ..... 227/7; 227/110

[58] Field of Search ..... 227/5, 7, 120, 130, 227/110, 156, 111

[56] References Cited

U.S. PATENT DOCUMENTS

| | | | |
|---|---|---|---|
| 2,915,754 | 12/1959 | Wandel | 227/5 |
| 3,984,040 | 10/1976 | Fry | 227/7 |
| 4,030,654 | 6/1977 | York | 227/110 |
| 4,265,387 | 5/1981 | Strouse | 227/7 |
| 4,350,279 | 9/1982 | Haley | 227/110 X |

FOREIGN PATENT DOCUMENTS

| | | | |
|---|---|---|---|
| 2221712 | 11/1973 | Fed. Rep. of Germany | 227/7 |
| 46-4953 | 2/1971 | Japan | 227/7 |

*Primary Examiner*—Paul A. Bell

*Attorney, Agent, or Firm*—Birch, Stewart, Kolasch & Birch

[57] ABSTRACT

A batten setter for laying batten strips on a roof surface at predetermined distances from each other including an automatic nailing device whereby movement of the batten setter along the roof automatically actuates nailing action at preselected intervals. The batten setter permits batten strips to be fastened on a subsurface with a uniform distance between the strips as the device is easily moved along the length of a previously fastened batten strip.

6 Claims, 7 Drawing Figures

AUTOMATIC BATTEN SETTER

BACKGROUND AND FIELD OF THE INVENTION

The present invention is directed to an improved batten setter for laying batten strips on a surface at a predetermined distance from each other. More particularly, the present invention is directed to an improved batten setter which includes an automatic nailing device for automatically nailing the batten strips by driving nails into the batten strips at predetermined intervals as the batten setter is moved along a subsurface.

The batten setter of this invention is an improvement on my earlier batten setter described in U.S. Pat. No. 4,350,279, which is hereby incorporated by reference. While the batten setter of my earlier patent provides a device for easily laying batten strips with a uniform distance between said strips, a workman using this device must still manually operate a nailing device in order to nail the batten strips to a subsurface. This procedure requires a workman to operate both the batten setter and the nailing device simultaneously and further requires the workman to continually or periodically bend over the batten setter in order to reach the nailing device. Applying batten strips in this manner can be both tiring and time consuming, especially when the batten strips are being applied to a surface such as a roof.

OBJECTS AND SUMMARY OF THE INVENTION

Accordingly, one object of the present invention is to provide a batten setter having an automatic nailing means which automatically nails batten strips to a subsurface at predetermined intervals.

It is another object of the present invention to provide a batten setting device with an automatic nailer which automatically senses the intervals at which nails should be driven into the individual batten strips.

It is a further object of the present invention to provide a batten setter having an automatic nailer which is automatically periodically actuated by movement of the batten setter along a batten strip on a subsurface.

It is a still further object of the present invention to provide a batten setter with an automatic nailer which is adjustable so as to actuate nailing action at varying preselected intervals.

These and other objects of the present invention are accomplished by providing an improved batten setter for laying batten strips on a roof surface at predetermined distances from each other including an automatic nailing device whereby movement of the batten setter along the roof automatically actuates nailing action at preselected intervals. The batten setter permits batten strips to be fastened on a subsurface with a uniform distance between the strips as the device is easily moved along the length of a previously fastened batten strip.

DETAILED DESCRIPTION OF THE INVENTION

Figure 1:
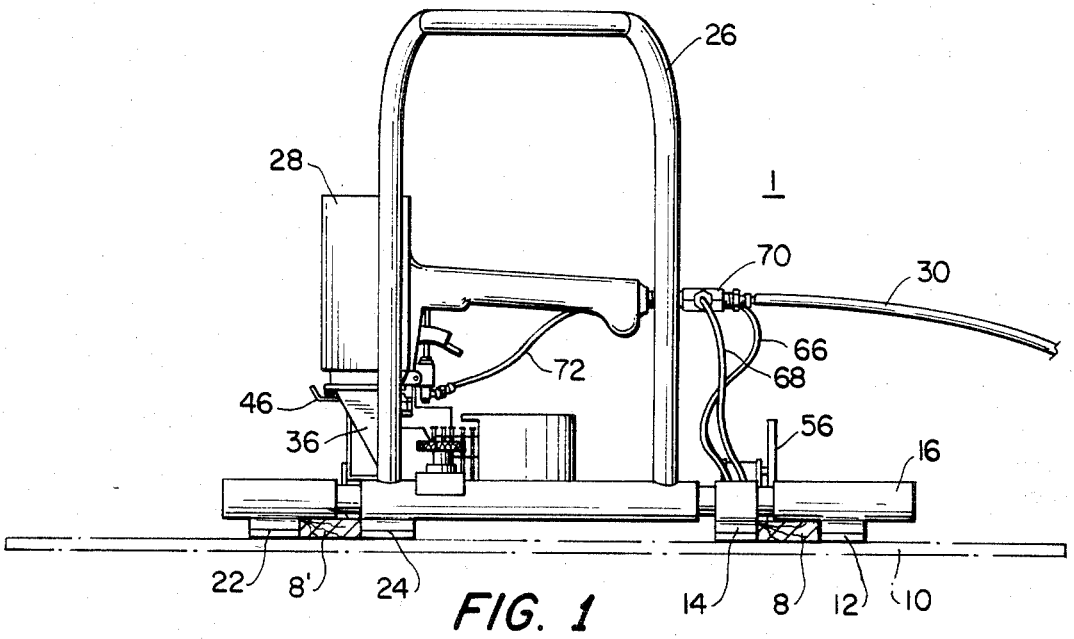
FIG. 1 is a side elevational view of the batten setter of the present invention showing how the batten setter is utilized for positioning two adjacent batten strips relative to each other.
Figure 2:
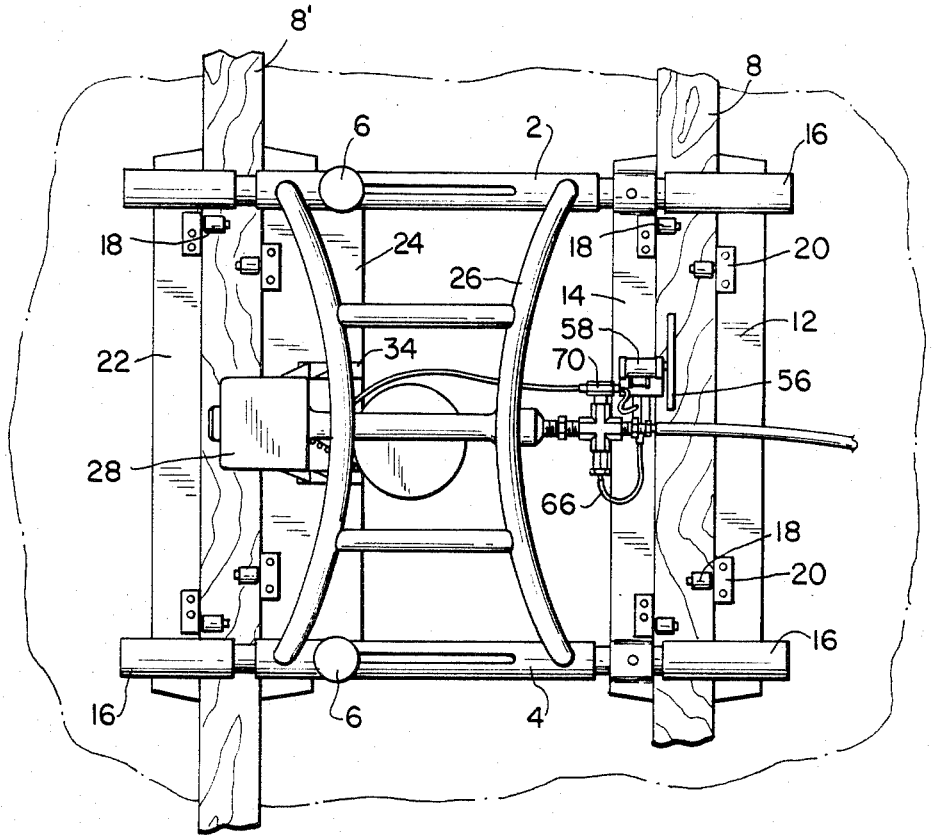
FIG. 2 is a top plan view of the batten setter shown in FIG. 1.

With reference to FIG. 1, the batten setter 1 of the present invention is utilized in attaching batten strips along the longitudinal length of the roof of a dwelling. Initially, a first batten strip is attached to the edge of the roofing by hand and extends along the longitudinal edge of the roof from one end of the dwelling to the other. The batten setter of the present invention is then utilized to attach subsequent batten strips parallel to and at desired spacing from this initial batten strip. First of all, the desired distance which is to be utilized between adjacent batten strips is selected and the telescopic arms 2 and 4 are manipulated relative to each other to position the device for establishing the desired distance between adjacent batten strips. Then the set screw 6 is tightened to hold the telescopic arms 2 and 4 in position. With the batten strip 8 secured to the roof surface 10, the horizontal frame members 12 and 14 are placed around the batten strip 8 and held in position by the spring-bias of said horizontal frame members 12 and 14. The horizontal frame members 12 and 14 are provided with a spring-bias force as a result of a spring means (not shown) contained within sleeve 16 as described in my earlier issued U.S. Pat. No. 4,350,279, which is hereby incoporated by reference. The horizontal frame members 12 and 14 further include two pairs of opposing rollers 18 which are secured by means of brackets 20. The rollers 18 facilitate movement of the batten setter along the batten strips.

With horizontal frame members 12 and 14 being held against the batten strip 8 by the spring-bias, the next subsequent batten strips 8' can be held in a desired position at the other end of the batten setter by a similar arrangement of structural elements. Thus, by using the first batten strip 8 as a guide, the second batten strip 8' can be readily positioned in a desired spacing from the batten strip 8 and nailed into position. Thus, it is not necessary to continually measure the distance between adjacent batten strips since this distance has already been predetermined by the adjustment of the telescopic members 2 and 4. As previously stated, roller means 18 facilitate the movement of the batten setter along batten strips 8 and 8' and sleeve 16 encompasses a spring means for spring-biasing horizontal frame members 22 and 24. Each of the sleeves 16 further encompasses a screw member (not shown) which is adjustable for securely compressing the batten strips 8 and 8' between the respective horizontal frame members. The batten setter is also provided with a brace member 26 which serves to stabilize the device and serves as a handle means to permit easy movement and manipulation of the batten setter along a roof.

Figure 4:
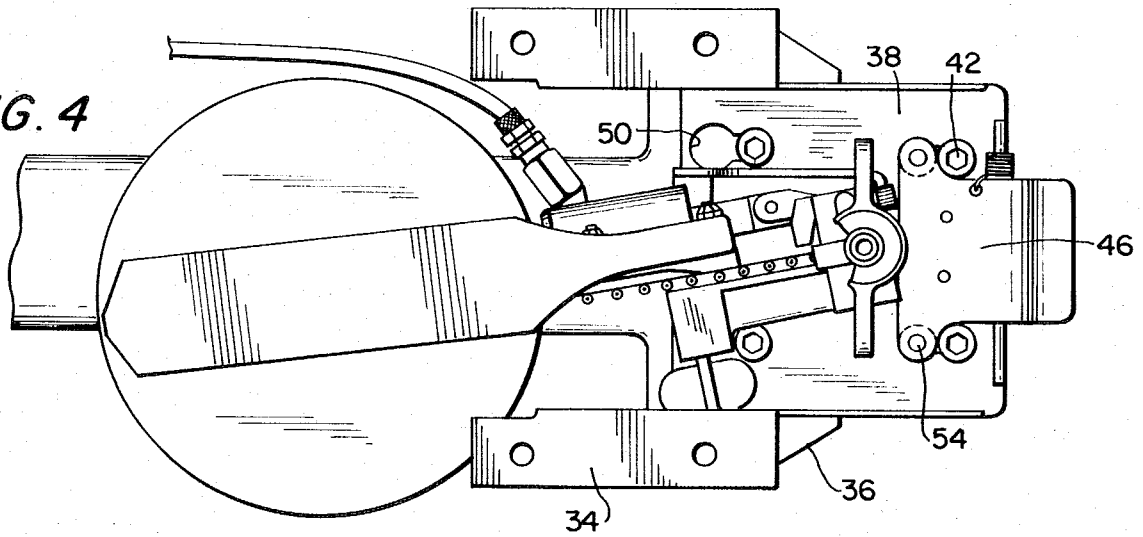
FIG. 4 is a bottom plan view of the nailer utilized in the batten setter having the bracket attached thereto.
Figure 3:
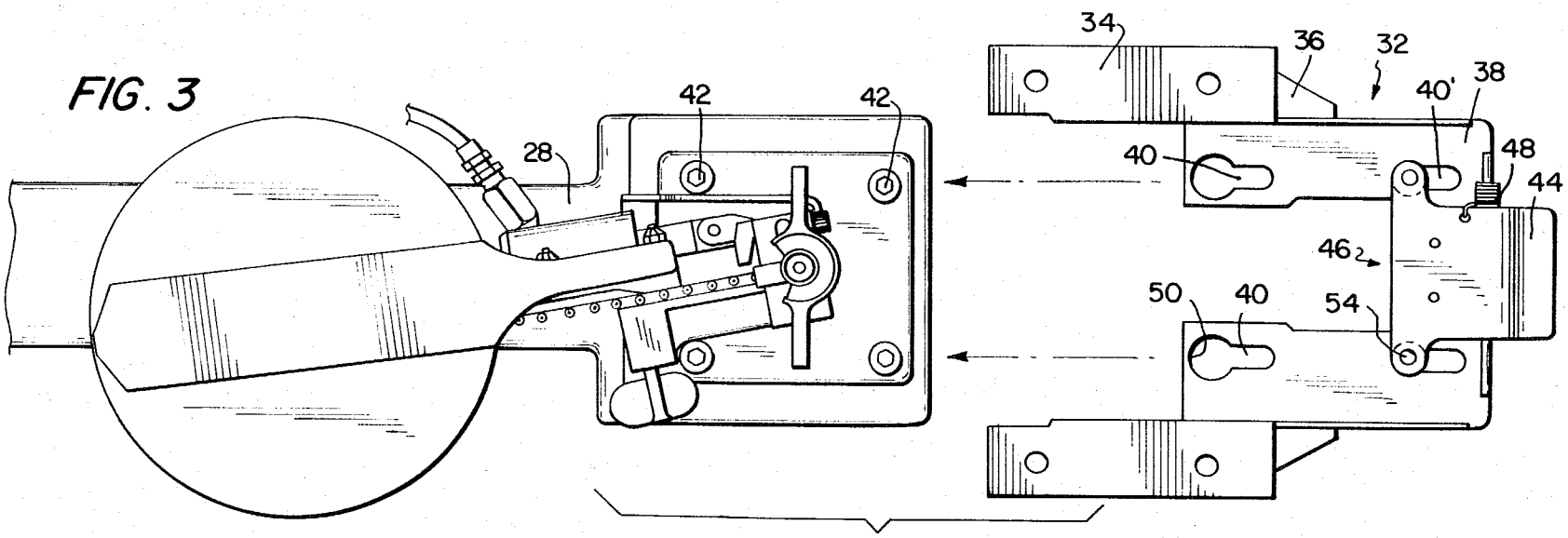
FIG. 3 is a partially exploded view of the automatic nailer of the batten setter and the bracket utilized to secure the nailer to the batten setter.
Figure 7:
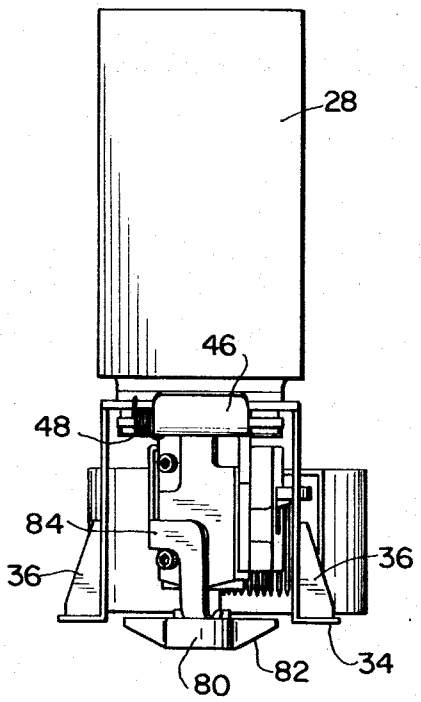
FIG. 7 is a front view of the automatic nailer used in the present invention.
Figure 6:
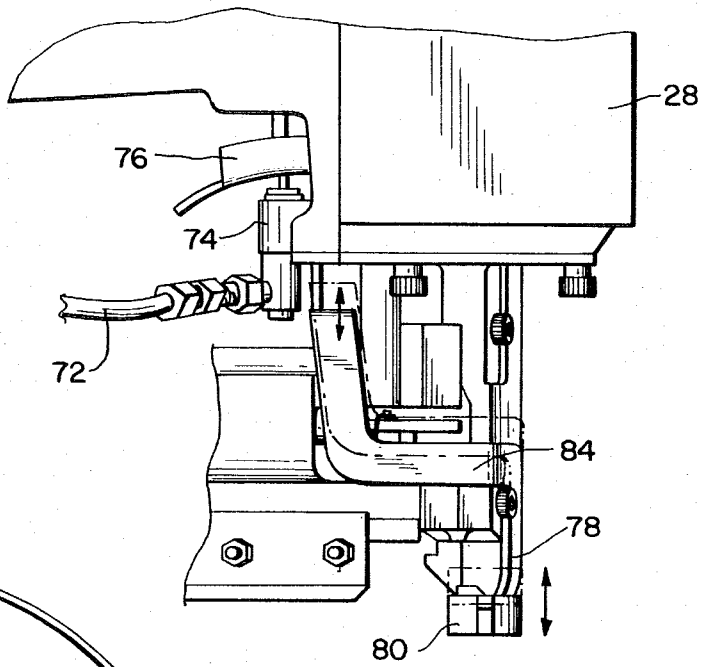
FIG. 6 is a side elevational view of a portion of the automatic nailer.
Figure 5:
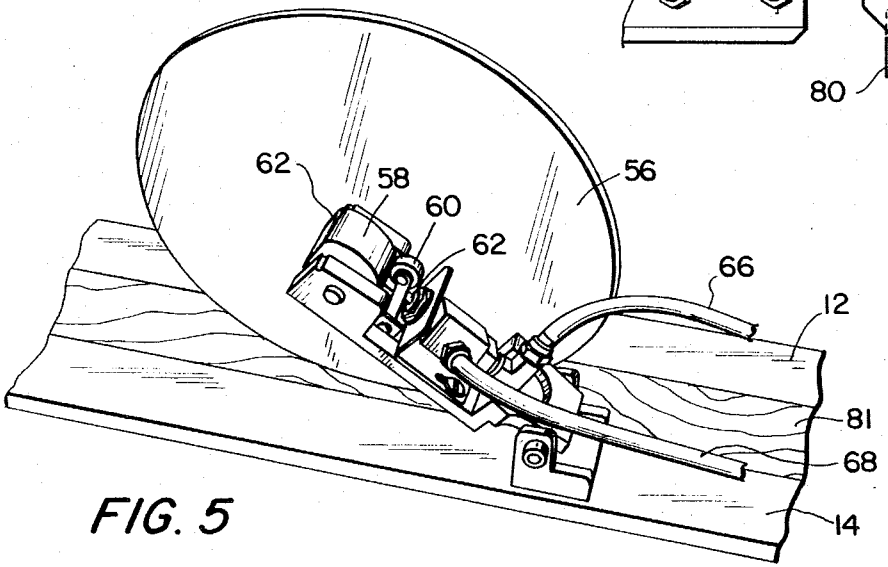
FIG. 5 shows the distance measuring means utilized in the present invention for automatically actuating the automatic nailer at preselected intervals.

The significant improvement of the present invention resides in providing an automatic nailing apparatus for nailing of the batten strips to the surface 10. To provide the nailing action, an automatic nailer 28 is utilized driven by compressed air supplied by a compressor (not shown) through airline 30. The automatic nailer 28 is secured to the batten setter 1 by the use of a bracket means 32 which is designed to releasably engage the automatic nailer and permit easy attachment and disattachment of the nailer from the batten setter. The bracket 32 is securely attached to the horizontal frame member 24 by means of foot portions 34 bolted or otherwise secured to the horizontal frame member 24. Vertical bracket portions 36 extend upward from the horizontal frame member 34 a desired distance to provide clearance from batten strips. The top horizontal portion 38 is provided with two pairs of slots 40 shaped to receive and engage bolts 42 on the undersurface of the nailer 28. As best shown in FIGS. 3 and 4, when it is desired to attach the nailer 28 to the batten setter apparatus, end 44 of latch 46 on the brackets 32 is depressed against the spring-bias action of spring 48 and the bolts 42 on the undersurface of the nailer are placed within the circular end portions 50 of the slots 40. Horizontal movement of the nailer 28 then moves the bolts 42 within the slots 40 into engagement with the narrow portion 52 of the slots 40. Latch 46 is then released and the action of spring 48 moves lugs 54 provided on both sides of latch 46 into engagement with the circular end portions of slot 40, thereby securing the position of the nailer 28. Reversing the above-described step then permits the nailer 28 to be easily removed from the batten setter.

To facilitate automatic nailing of the batten strips to the surface 10, the batten setter of the present invention is provided with a means for automatically initiating the action of automatic nailer 28 at preselected intervals. To accomplish this objective, a wheel 56 is secured to horizontal frame member 14 and positioned in rolling engagement with batten strip 8. As the batten setter apparatus 1 is moved along the surface 10, wheel 56 is caused to rotate, thus causing corresponding rotation of cam 58 which is rotatably secured thereto about the same axis. Cam 58 is of a double oblong shape, so that, rotation of cam 58 causes pivotal movement of follower 60. When the outermost edge 62 of the cam 58 contacts follower 60, follower 60 engages and opens valve 62, preferably a needle valve, permitting compressed air to flow from hose line 66 into hose line 68. This flow of compressed air continues through valve fitting 70, through hose 72 and eventually exiting hose fitting 74 whereupon the impact of the compressed air on the trigger 76 causes upward motion of said trigger permitting, as in a conventional automatic nailer, flow of compressed air through line 30 and into the nailer 28 whereupon a single nail is driven into the batten strip 8'.

Continued movement of batten setter 1 along the surface 10, and thus movement of wheel 56 along batten strip 8', periodically initiates the nailing operation of automatic nailer 28 each time an outer edge 62 of cam 58 contacts the follower 60 opening valve 62. The particular spacing of the nailing operation can be varied and preselected by varying the size of the wheel 56 and cam 58.

When laying a plurality of batten strips, adjacent horizontal sections of batten strips are conventionally secured with a small space therebetween in order to provide a passage means for water flowing along a roof surface, thereby preventing water from accumulating along the lengths of the batten strips. The automatic nailer 28 of the present invention is therefore adapted with a means to prevent the nailing end of the nailer from coming into binding contact with the spaces between adjacent horizontal batten strip lengths. Nails exit the automatic nailer from an exit tip 78. According to the present invention, this portion of the nailer is provided with a stop means 80 having its length parallel to the direction of the batten strips 8' and having sloping portions 82 at both bottom surfaces thereof. Stop means 80 is secured to a vertically reciprocating arm 84. Accordingly, as the batten setter 1 is moved along the horizontal lengths of a batten strip 8' and subsequently reaches a space between adjacent batten strips 8', the sloping portions 82 of the stop means 80 will engage the ends of the batten strip 8' allowing the nailer to easily slide past the separating space and preventing the exit tip 78 of the nailer from becoming jammed within the space between adjacent batten strips.

The batten setter of the present invention therefore provides a device which is very effective in attaching batten strips to a surface, for example the roof of a dwelling, while providing a substantially equal distance between adjacent batten strips, in a relatively short period of time. The improved batten setter of the invention facilitates easy attachment of batten strips by providing a means for periodically and automatically initiating automatic nailing of the batten strips as the batten setter is moved along the roof surface. In addition, the batten setter of the invention can be used for fastening wood shingles and for strip sheeting for metal roofs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An automatic nailer comprising:

a nailing gun having a trigger means for initiating a first supply of compressed air to said nailer for providing a nailing force; and an air hose line for providing a second supply of compressed air and having an air outlet means at one end thereof being operatively associated with said trigger means, exiting of compressed air from said air outlet means impinging directly upon said trigger means to actuate said trigger means, thereby initiating said first supply of compressed air to said nailer for providing a nailing force.

2. A batten setter which is adapted to be moved along a surface for spacing batten strips on said surface at a predetermined distance from each other which comprises:

a first end portion and a second end portion, said first and second end portions being connected together by at least one adjustable frame member so that the distance between said first and second end portions can be varied depending upon the desired distance between batten strips;

each of said end portions including first and second spaced apart, spring-biased, guide frame members which are adapted to be positioned on opposite sides of said batten strips for clamping and sliding along said batten strip;

an automatic nailer associated with said batten setter;

trigger means on said automatic nailer, actuation of said trigger means initiates supply of compressed air to said nailer for providing a nailing force;

a wheel in rolling contact with one of said batten strips for measuring distances along one of said batten strips;

valve means associated with said batten setter, including a compressed air inlet means and a compressed air outlet means, exiting of compressed air from said air outlet means inpinging directly upon said trigger means;

cam means rotatably associated with said distance measuring means and operatively associated with said valve means, movement of said wheel along one of said batten strips effects rotation of said cam means; and a follower means operatively associated with said cam means and said valve means, rotation of said cam means causing movement of said follower means which periodically actuates said valve means permitting air passage through said compressed air outlet means for actuating said trigger means.

3. A batten setter as in claim 2, wherein said batten setter includes a bracket means for releasably engaging said nailer.

4. A batten setter as in claim 2, wherein said batten setter includes a bracket means for releasably engaging said nailer comprising:

a frame;

slots in said frame, each of said slots having a first and a second end, said first end being larger in size than said second end for receiving said nailer; and latch means spring-biased to said frame and having projection means associated therewith for engagement in said first end of said slots in said frame, whereby said nailer is releasably secured to said bracket means.

5. A batten setter as in claim 2, wherein the size of the interval between successive nailings is adjustable by varying the size of said wheel and said cam means.

6. The automatic nailer as in claim 2, which includes a nail exit means having a stop means associated therewith for preventing jamming of said nail exit means.

* * * * *